US008695945B2

(12) United States Patent
Guyard

(10) Patent No.: US 8,695,945 B2
(45) Date of Patent: Apr. 15, 2014

(54) HAND WINCH WITH BRAKE AND FREEWHEEL

(76) Inventor: Francois-Xavier Guyard, Chambon sur cisse (FR)

( * ) Notice: Subject to any disclaimer, the term of this patent is extended or adjusted under 35 U.S.C. 154(b) by 620 days.

(21) Appl. No.: 12/855,083

(22) Filed: Aug. 12, 2010

(65) Prior Publication Data

US 2011/0062273 A1 Mar. 17, 2011

(30) Foreign Application Priority Data

Aug. 13, 2009 (EP) ..... 09010459

(51) Int. Cl.
*B66D 1/14* (2006.01)
*B66D 5/32* (2006.01)
*B66D 3/00* (2006.01)

(52) U.S. Cl.
USPC ..... 254/346; 254/342; 254/350; 254/357; 254/376; 254/380

(58) Field of Classification Search
USPC ..... 254/346, 345, 342, 347, 348, 350, 356, 254/357, 375, 376, 380; 464/30; 192/56.1, 192/56.6
IPC ..... B66D 1/16
See application file for complete search history.

(56) References Cited

U.S. PATENT DOCUMENTS

| | | | | |
|---|---|---|---|---|
| 2,649,281 | A * | 8/1953 | Hastings, Jr. | 254/344 |
| 3,047,114 | A * | 7/1962 | Stevens, Jr. | 192/16 |
| 4,471,946 | A * | 9/1984 | Maeda | 254/350 |
| 5,217,084 | A * | 6/1993 | Olson et al. | 182/234 |
| 5,271,607 | A * | 12/1993 | Kubota et al. | 254/342 |
| 5,305,989 | A * | 4/1994 | Nishi et al. | 254/352 |
| 5,573,091 | A * | 11/1996 | Hung | 192/12 R |
| 6,110,061 | A * | 8/2000 | Kishibuchi et al. | 474/17 |
| 6,405,612 | B1 * | 6/2002 | Kinoshita et al. | 74/411 |
| 7,793,919 | B2 * | 9/2010 | Guyard | 254/346 |

FOREIGN PATENT DOCUMENTS

EP 2058266 A1 * 5/2009

* cited by examiner

*Primary Examiner* — Emmanuel M Marcelo
*Assistant Examiner* — Justin Stefanon
(74) *Attorney, Agent, or Firm* — R. Michael West

(57) ABSTRACT

A hand winch including a winding roll, a flexible elongated member, a shaft connected to the winding roll, a friction brake including a brake disk and a gear element engaging the winding roll and mounted on the shaft. The gear element has a release position and a brake position in which the gear element enters into frictional contact with the brake disk, generating a braking torque resisting winding off the flexible elongated member. Friction means is provided between the shaft and the gear element for generating a frictional resistance therebetween such that, if a driving force acting on the gear element does not overcome the frictional resistance established by the friction means, the gear element drives the shaft through friction means. However, if the driving force between the shaft and the gear element overcomes the frictional resistance, relative movement between the gear element and the shaft occurs.

7 Claims, 4 Drawing Sheets

HAND WINCH WITH BRAKE AND FREEWHEEL

CLAIM OF PRIORITY

Applicant claims foreign priority benefits under Title 35, United States Code, Section 119(a)-(d) or (f), or 365(b), of the foreign patent application identified following: Foreign Application No. EP 09 010 459.7, filed in the European Patent Office, having a Filing Date of Aug. 13, 2009.

BACKGROUND OF THE INVENTION

1. Field of the Invention

The invention refers to a hand winch which comprises a rotating winding roll for winding up and winding off a flexible elongated member, such as a belt, a band, a cable or the like.

2. Description of the Prior Art

Typically, prior art hand winches included a rotatable rotation shaft engaged with a winding roll for transmitting manual operating forces via a crank handle connected to the shaft for rotating the winding roll. Further, specific hand winches have included an automatically activating friction brake such that the friction brake is activated automatically when a pulling load is applied to the elongated member wound up on the winding roll.

Such a known hand winch having a friction brake is disclosed in EP 2 058 266 A1. The friction brake includes a gear member mounted between the winding roll and the shaft in such a way that it can axially move along the shaft between a release position and a brake position in which it enters into friction contact with a brake disk releasably fixed to a housing of the hand winch, thereby generating friction forces that act on the gear member and thus on the winding roll and the elongated member. The fixation of the braking disk to the housing is realized by a ratchet system designed to be moved between an engaged position in which the ratchet fixes the braking disk and an off-set position in which the brake disk can freely rotate. The ratchet system functions as a mechanism for activating and deactivating the automatic capabilities of the brake system. The ratchet can be moved from the engaged position to the off-set position by movement of a pivot member of the housing of the hand winch. When a load is applied to the elongated member, the latter causes the housing element to move the ratchet into the engaged position and simultaneously the gear member entrained by the winding roll moves axially from the release position to the brake position, generating braking forces opposite the direction of unwinding the elongated member. In order to let down a load applied to the elongated member, a crank handle can be plugged into the operating shaft in order to reduce and overcome the friction forces generating the friction brake and let down the load by unwinding the elongated member.

A disadvantage of this prior art hand winch is that when the friction brake is deactivated through the brake disk being switched to the off-set position, a rapid unwinding of the belt by pulling it will result in a quick rotation of the shaft. If in this situation the crank handle is still mounted on the shaft, the crank handle will rotate with the same angular speed as the shaft, possibly resulting in injury of the operator or a bystanding person.

A further disadvantage of this hand winch shown in EP 2 058 266 A1 is that the automatic capabilities of the friction brake can only be deactivated in dependence of the position of the pivot member of the housing which causes the ratchet element to engage the brake disk or to disengage the brake disk. For an inexperienced operator of the hand winch it is not clear in which operating condition the automatic friction brake is activated and in which one it is not. Further, in order to quickly unwind the elongated member by pulling it, the elongated member must be pulled in a certain direction, corresponding to the required specific position of the pivot member of the housing of the hand winch.

It is an object of the invention to overcome these disadvantages of the prior art, in particularly to provide a hand winch including an automatic friction brake which is ergonomically improved.

SUMMARY OF THE INVENTION

Accordingly, the hand winch of the invention comprises a stationary housing, a winding roll for receiving a flexible elongated member, a manually operated shaft acting on the winding roll, and a friction brake. The friction brake includes a brake disk fixed to the housing particularly by a ratchet always engaged with the brake disk so that rotation of the brake disk relative to the housing is avoided at least in one turning direction of the brake disk. Further, the friction brake includes a gear member being in a revolving engagement with the winding roll and particularly rotatably mounted on the shaft such that the gear member can rotate with respect to the shaft when overcoming an initial resistance against its movement relative to the shaft that opposes rotation. By way of example, the initial inertia of the shaft including elements fixed thereon provides initial resistance particularly consisting of friction between the shaft and the gear member. In a relative movement of the gear member with respect to the shaft, the gear member is forced to axially move along the shaft between a release position in which it is not in contact with the fixed brake disk and therefore no braking forces are generated for braking the winding roll, and a brake position in which the gear member is in frictional contact with the brake disk whereby a braking torque is applied to the winding roll opposite to its turning direction when winding off the flexible elongated member.

According to the teachings herein, a friction means is provided to be positioned between the shaft and the gear member and to increase or establish a friction resistance between the shaft and the gear member such that in the case that a driving force acting on the gear member does not overcome such increased friction resistance predetermined by the friction means, the gear member entrains the shaft via the friction means without slippage of the friction means. In the case that the driving force between the shaft and the gear member overcomes the increased frictional resistance, slippage and relative rotation may occur between the gear member and the shaft.

The friction means is designed to be able to transfer static friction forces between the shaft and the gear member such that the rotating gear member can entrain the shaft without allowing slippage, i.e. relative movement, between the shaft and the gear member. Only if an external resistance applied to the shaft becomes larger than the static friction forces generated by of the friction means, the friction forces will become too small to entrain the shaft, and slippage between the gear member and the shaft will occur, resulting in an activation of the friction brake.

Preferably, the friction means is mounted in an annular cavity between the shaft and the gear member particularly such that the friction means is slightly compressed, for generating an increased frictional resistance between the gear member and the shaft. The annular cavity can extend circumferentially. The cavity can be confined by an inner surface of the gear member and an outer surface of the shaft. The technical measure of providing a friction means between the shaft and the gear member that predetermines a torque threshold representing a maximum transferable torque between the shaft and the gear member without slippage, has the effect that the elongated member can be unwound conveniently without concern that the friction brake will become activated. This results because the winding roll turns the gear member, and the friction member transfers the rotational movement of the gear member to the shaft without slippage, so that there is no relative movement between the gear member and the rotational shaft. The friction brake cannot be activated as long as the friction means entrains the shaft and avoids revolving movement of the shaft relative to the gear member.

An inventive aspect of the friction means relates to its function of entraining the shaft particularly without slippage only if a counter torque acting on the shaft does not exceed the predetermined torque threshold established by the friction means. If an externally applied counter torque is subjected to the shaft that is larger than the predetermined torque threshold maximally transferable by the friction means, the gear member starts rotating with respect to the shaft and therefore is forced to move axially from the release position to the brake position, so that the gear member comes into frictional contact with the brake disk in order to brake the winding roll. The counter torque applied to the shaft can be realized even by only slightly touching the shaft or by the inertia of a crank handle being fixed to the shaft.

The friction means can be provided by any structural element which is capable of increasing the frictional resistance between the shaft and the gear member. For example, the friction means can be structurally integrated with either the shaft or the gear member. As a more specific example, the friction means can be provided by an internal surface of the gear member and an external surface of the shaft rubbing against each other. A dimensional fit between the shaft and the gear member can be defined such that a predetermined friction resistance between the internal surface of the gear member and the external surface of the shaft is provided. The frictional resistance can be adjusted by the dimensional fit between the gear member and the shaft.

In a preferred embodiment, the friction means comprises a structural member separated from the shaft and from the gear member, and particularly is separately mounted.

In a preferred embodiment, the friction means is mounted in a receiving recess formed in the shaft and/or in the gear member. So secured, the friction means projects radially out of the recess for radially bridging a gap between the gear member and the shaft. The more the friction means projects out of the recess, the larger the frictional resistance can be adjusted and thereby the maximum torque transferable by the friction means. By varying the dimension of the cross section of the friction means, it is possible to adjust the torque threshold according to the wishes of the producer.

Preferably, the friction means is positioned within a circumferential groove formed in the shaft or in the gear member. The groove can extend circumferentially without any interruption.

In a further embodiment of the invention, the friction means comprises a resilient material, in particular, an elastomer configured as an elastic O-ring.

In a further embodiment of the invention, the gear member and the shaft each have a threaded portion and an unthreaded portion. The threaded portions of the gear member and the shaft cooperate with each other such that when the gear member rotates, it is forced to axially move between the release and brake positions. The annular cavity in which the friction means is mounted, is radially confined by the unthreaded portions of the gear member and the shaft, the friction means being positioned between the unthreaded portion of the gear member and the unthreaded portion of the shaft.

In a preferred embodiment of the invention, the friction means is in frictional contact with the gear member and in frictional contact with the shaft in any axial position of the gear member moving between the release position and the brake position.

In a further embodiment of the invention, an external friction surface of the friction means is in frictional contact with the gear member in any axial position moving between the release position and brake position.

However, one portion of the external friction surface can come out of frictional contact with the gear member when the gear member is in the release position, while another portion of the external friction surface is still in frictional contact with the gear member. The friction means is always in at least partial frictional contact with the gear member. Thus, in the release position the friction force between the friction means and the gear member can be reduced compared to the position where the entire external friction surface is in frictional contact with the gear member. The effect of this aspect of the invention is that even if seizure of the friction means with the gear member has occurred resulting from a prolonged period of non-use of the hand winch, the seizure only takes place at the portion of the external friction surface being in contact with the gear member. The non-contacting structural friction surface remains untouched and provides a proper function of entraining and releasing the shaft in a predetermined manner.

In a further embodiment, a torque threshold maximally transferable from the gear member to the shaft and corresponding to the increased friction resistance, is less than 5 Nm, particularly less than 2 Nm, more particularly less than 1 Nm, more particularly less than 0.3 Nm, in particular less than 0.05 Nm, especially less than 0.01 Nm. The low threshold torque enables rapid activation of the friction brake as soon as a minor counter torque is applied to the shaft, for example by the user.

In a preferred embodiment of the invention, the friction resistance of the friction means is adjusted such that the inertia of the shaft can be entrained by the gear member via the friction means, but in the case of an increased inertia of the shaft caused by adding an additional inertia mass, in particular the crank handle, the entraining torque of the gear member cannot be transferred to the shaft by way of the friction means. Even if the torque between the gear member and the shaft results from merely pulling the elongated member without load, the torque cannot be transferred into the shaft when the additional inertia mass is mounted, since the frictional resistance of the friction means is not sufficiently high. Only by unmounting the additional inertia mass the shaft is entrained and the friction brake is deactivated. Thus, the friction brake cannot be deactivated when the crank handle is mounted on the shaft. Furthermore the hand winch of the device herein assures that a mounted crank handle cannot be driven in rotation by the gear member, and thus, the risk of injury for an operator is essentially reduced.

In a further aspect of the disclosed device, the brake disk is axially slidingly mounted on the shaft such that it transmits an axial force generated by the gear member onto a counter bearing, which is arranged onto the shaft and comprises two disks mounted onto the shaft. This aspect of the invention has the effect of saving costs of manufacturing the hand winch because welding of the counter bearing onto the shaft can be avoided and of improving the endurance of the friction brake construction.

In a further embodiment of the invention, the counter bearing comprises a first disk for transmitting only torque to the shaft and a second disk detached from the first disk for transmitting only axial forces to the shaft. The advantage of this aspect of the invention is that each disk of the counter bearing transmits only one force component into the shaft. Thus, each of the disks can be designed to be very wear resistant for a specific force component, for example by individually hardening the disk at its respective working surfaces.

In a further embodiment of the invention, the first disk is mounted on the shaft with a circumferential form fit such as a hexagonal shape, and the second disk is mounted on the shaft with an axial form fit, like a circumferential groove. The advantage of this design is to enable easy mounting and demounting of the two disks to and from the shaft.

Furthermore, the counter bearing, bearing the axial pressure of the friction brake, is manufactured in such a way that costly welding procedures for manufacturing the hand winch are avoided.

Furthermore, the invention relates to a method for deactivating a friction brake of a hand winch particularly according to the invention, comprising a winding roll for receiving a flexible elongated member and a manually operated shaft acting on the winding roll, wherein the friction brake is automatically activated if there is a relative rotation between a gear member of the friction brake with respect to the shaft. In particular the relative rotation makes the a gear member coming into frictional contact with a brake disk of the friction brake being stationary with a housing of the hand winch. According to the invention a predetermined frictional resistance between the gear member and the shaft is caused and adjusted such that if a driving force acting on the gear member does not overcome the predetermined frictional resistance, the gear member drives the shaft and if the driving force acting on the gear member overcomes the increased friction resistance, a relative movement of the gear member with respect to the shaft is allowed.

It is clear that the method of the invention can be defined by the function of the above mentioned hand winch of the invention.

The present invention provides a hand winch with which loads can be pulled up and let down while ensuring that when a load is attached to the hand winch, upon release of the crank handle by the user, the load will be held securely by means of the automatically engaging friction brake. The hand winch according to the teachings herein further allows the user to deactivate the friction brake, particularly when the crank handle is removed, so that the flexible member can be unwound quickly by pulling it, wherein the friction brake can be reactivated reliably and fast by simply touching the shaft even without the need to reinsert the crank handle.

BRIEF DESCRIPTION OF THE DRAWINGS

Further features and advantages of the invention are described in the following by means of the description of a preferred embodiment in view of the enclosed figures in which.

Figure 1:
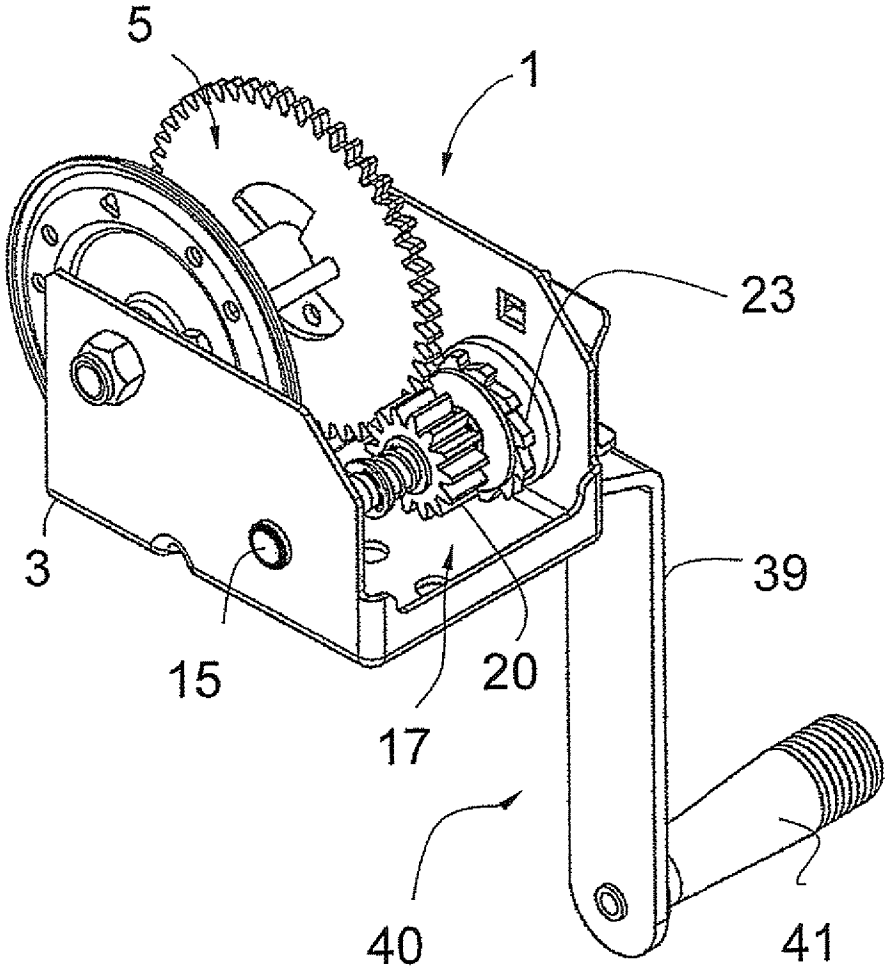
FIG. 1 shows a perspective view of the hand winch.

| List Of Reference Numerals | |
|---|---|
| 1 | hand winch |
| 3 | housing |
| 5 | winding roll |
| 7 | primary axis |
| 9 | securing bar |
| 11 | gear wheel |
| 13 | side plate |
| 15 | shaft |
| 16 | threaded portion of shaft |
| 17 | friction brake |
| 20 | pinion |
| 21 | threaded portion of pinion |
| 22 | unthreaded portion of pinion |
| 23 | brake disk |
| 24 | first washer |
| 26 | second washer |
| 27 | torque transmitting disk |
| 29 | axial force transmitting disk |
| 30 | counter bearing |
| 33 | counter bearing groove |
| 35 | first bearing |
| 37 | second bearing |
| 39 | lever |
| 40 | crank handle |
| 41 | handle |
| 43 | spring |
| 49 | friction groove |
| 50 | O-ring |

DETAILED DESCRIPTION OF THE PREFERRED EMBODIMENT

In FIGS. 1 to 3, the hand winch according to a preferred embodiment of the invention is generally denoted with the reference numeral 1. While FIGS. 1 and 2 show the hand winch in the release position, FIG. 3 shows the hand winch in a brake position. In the description to follow, the main elements of the hand winch according to the preferred embodiment of the invention are introduced.

The hand winch 1 comprises a housing 3 which has a U-shaped cross section. Between two side walls of the housing 3 representing the legs of the U primary axis 7 of winding roll 5 is mounted. The winding roll 5 further comprises a securing bar 9 for securing a flexible elongated member on the primary axis. In this embodiment, the flexible elongated member is a belt for winding up a boat (not shown). The winding roll 5 further comprises a gear wheel 11 and a side plate 13 for giving lateral support to the belt as it is wound up.

Furthermore, a shaft 15 is mounted at the housing 3, passing through the two side walls of the housing. On the portion of the shaft located inside the housing between the two side walls, friction brake 17 is mounted, which comprises the following elements: a pinion 20 engaged with the gear wheel 11; a brake disk 23 movably mounted on the shaft 15 mechanically linked to a ratchet mechanism (not shown) that is fixed to the housing 3, in order to avoid a rotation of the brake disk 23. Between the brake disk 23 and the pinion 20, a first washer 24 is located. On the side of the brake disk opposite to pinion 20, a counter bearing 30 is located. The counter bearing 30 comprises a torque transmitting disk 27 and an axial force transmitting disk 29. The axial force transmitting disk is mounted in a counter bearing groove 33. The torque transmitting disk 27 is mounted between the axial force transmitting disk and the brake disk on a shouldered portion 31 of the shaft, the circumferential shape of which is hexagonal. The hole in torque transmitting disk 27 correspondingly has a hexagonal shape. Between torque transmitting disk 27 and brake disk 23, a second washer 26 is located.

At the locations where the shaft 15 penetrates the side walls of housing 3, a first bearing and a second bearing 35, 37 are mounted. At the portion of the shaft 15 outside housing 3, crank handle 40 is mounted comprising of handle 41 and lever 39.

On the side of pinion 20 opposite to the friction brake, spring 43 is mounted on the shaft, biasing the pinion towards the brake disk 23. The pinion 20 and the shaft 15 both have a threaded portion 21, 16, which are in engagement which each other when the hand winch is in operation. The thread engagement between the pinion 20 and the shaft 15 causes the pinion 20 to move axially along the shaft 23 to the brake disk 23. On the section of the shaft between threaded portion 16 and shoulder 31, adjacent to the threaded portion 16, the shaft has a groove 49 in which a friction means in form of an O-ring 50 is located. Depending on the position of pinion 20, the outer surface of O-ring 50 is in total or in partial contact with unthreaded portion 22 of the inner side of pinion 20.

Figure 2B:
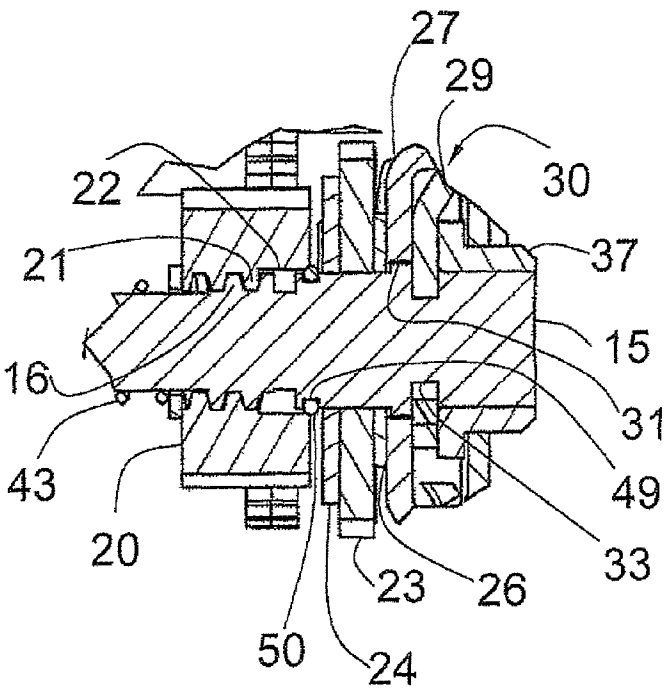
FIG. 2*b* is a detailed view of section IIb, shown in FIG. 2*a;*
Figure 2A:
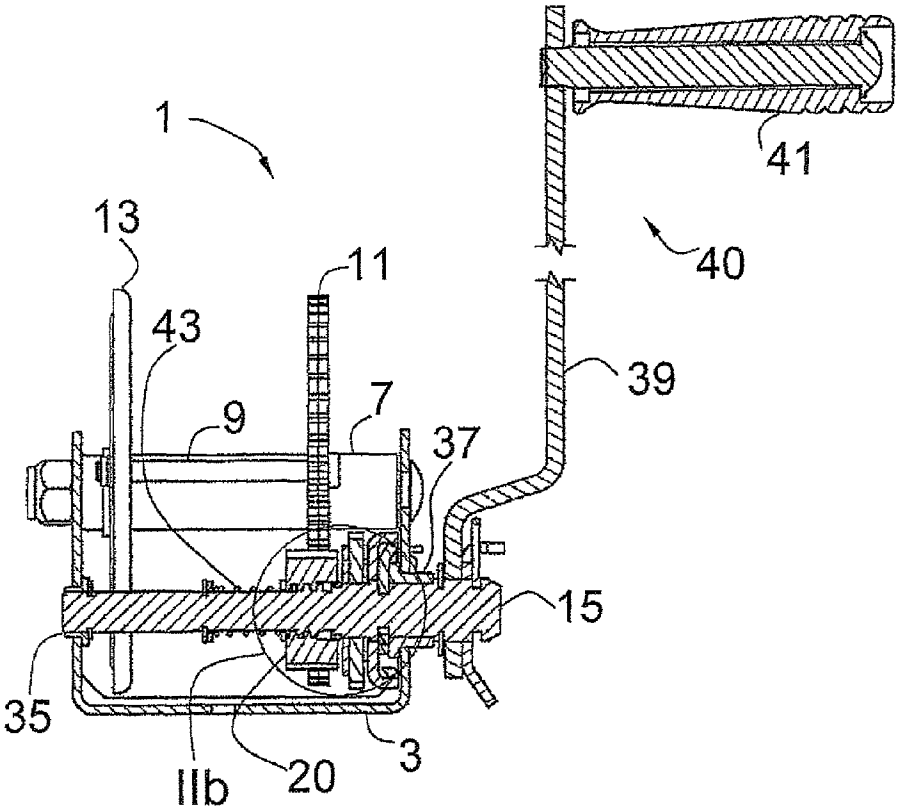
FIG. 2*a* shows a cross-sectional view of the hand winch with the gear member in the release position and with the friction brake in a non-braking state.

FIGS. 2*a* and 2*b* show the hand winch 1 with pinion 20 in a release position with a gap between the pinion 20 and the brake disk 23. When the belt is pulled for example by a load (not shown) hanging on the belt, the belt will cause the winding roll (5), the primary axis 7 and thus the gear wheel 11 to rotate and to drive the pinion 20. Through O-ring 50, the pinion 20 will transmit a torque to shaft 15. However, the forces of inertia and gravity caused by crank handle 40 produce a counter torque opposite to the torque generated by the pinion 20. The O-ring 50 is dimensioned such that the torque transmitted by the O-ring 50 into the shaft is smaller than the counter torque caused by the inertia of crank handle 40. Thus, due to the load pulling on the belt, pinion 20 will rotate relative to the shaft 15, and because the threaded portion 21 of pinion 20 is engaged with the threaded portion 16 of shaft 15, the pinion 20 is forced to move in axial direction along the shaft 15 towards brake disk 23.

Figure 3B:
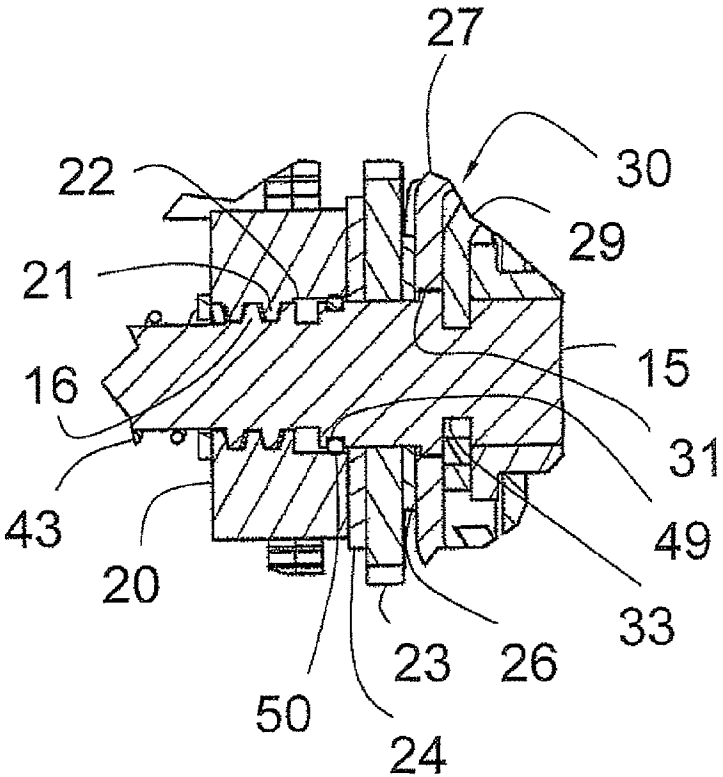
FIG. 3*b* is a detailed view of section IIIb, shown in FIG. 3*a;*
Figure 3A:
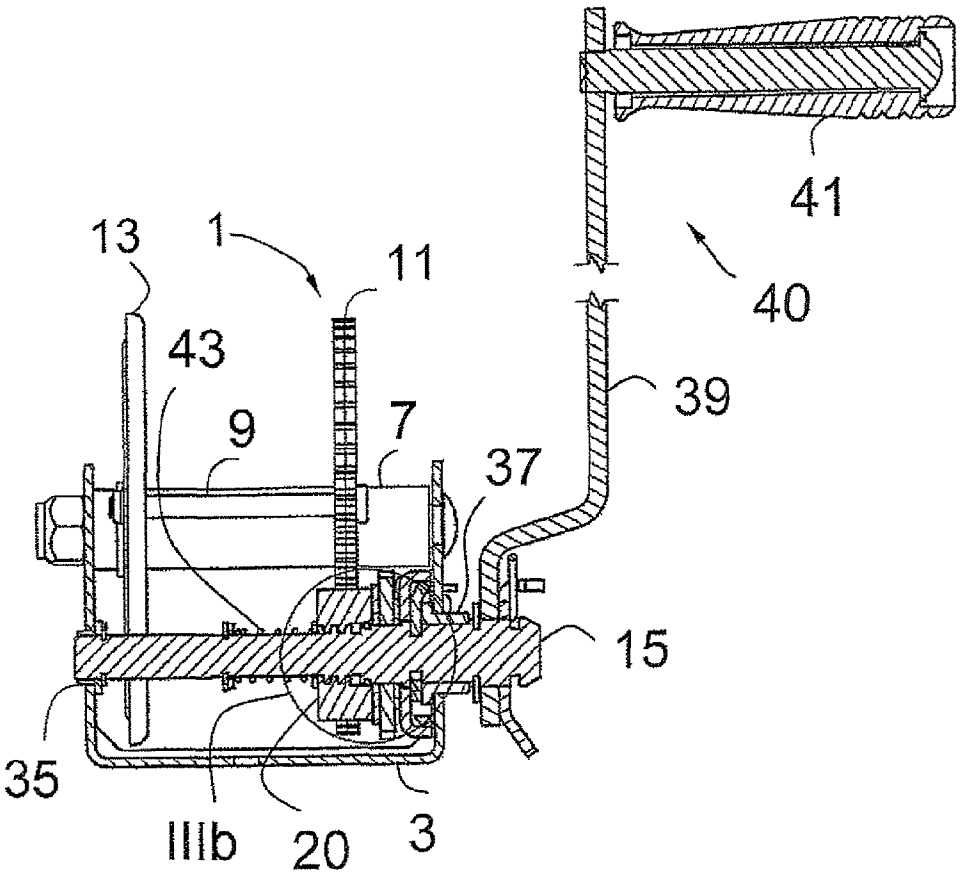
FIG. 3*a* shows a cross sectional view of the hand winch with the gear member in the brake position and the friction brake in a braking state.
Figure 4C:
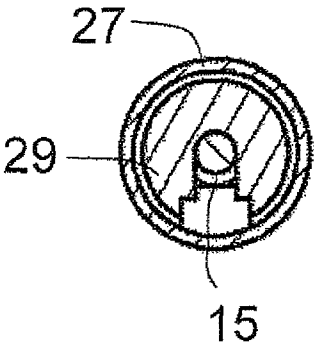
FIG. 4*a* is a side view of a shaft structure holding the gear member, the friction disk and the counter bearing of the hand winch.
FIG. 4*b* is a cross-section view of the shaft structure, taken along the line IVb-IVb in FIG. 4*a*; and, FIG. 4*c* is a cross-section view of the shaft structure, taken along the line Ivc-IVc in FIG. 4*a*.
Figure 4B:
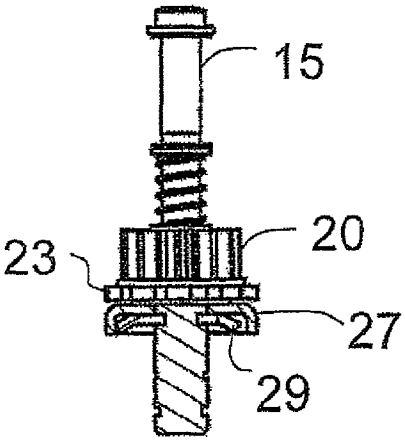
Figure 4A:
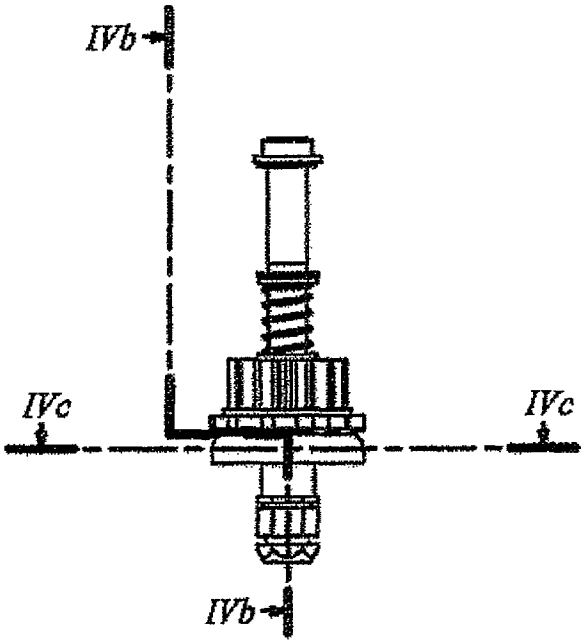

As shown in FIGS. 3*a* and 3*b*, upon entering into contact with the brake disk 23, further movement in axial direction of the pinion 20 is prevented, because the brake disk 23 abuts counter bearing 30, which is stationary with the shaft 15. Due to the brake disk 23 being stationary with respect to housing 3 by means of a ratchet mechanism (not shown), the friction between the pinion 20 and the brake disk 23 and the friction between the threaded portion 21 of pinion 20 and the threaded portion 16 of shaft 15 will impede rotation of the pinion 20. Because the pinion 20 is engaged with gear wheel 11, rotation of the gear wheel 11 and the primary axis 7 is also impeded, thereby stopping the load on the belt from descending. In this configuration, the pinion 20 and the brake disk 23 are immobilised with respect to the shaft 15. Thus, the belt can be wound up and thereby the load attached to the belt be lifted by turning the crank handle 40 so that pinion 20 drives the primary axis 7 through gear wheel 11. If the crank handle 40 is rotated in opposite direction, the friction grip between the threaded portions 16, 21 of the shaft 15 and the pinion 20 is overcome, and the pinion 20 will rotate by a small amount with respect to shaft 15. Thus, the pinion 20 will slightly move away from the brake disk 23 in axial direction, thereby reducing the friction between the pinion 20 and the brake disk 23. Thus, the pinion 20 can rotate with the shaft 15 in a direction of unwinding the belt, thereby lowering a load in a control manner.

In the arrangement shown in FIGS. 2*a* and 2*b*, if no load is applied to the belt, the crank handle 40 can be unmounted from shaft 15. If in this configuration the belt is pulled by an operator, the gear wheel 11 will drive the pinion 20 which in turn will drive shaft 15 by means of the friction force generated by O-ring 50. Thus, the pinion 20 will not rotate with respect to the shaft 15 and therefore not move axially to enter into contact with brake disk 23, so that the belt can be unwound quickly. During unwinding of the belt, the friction brake can be activated at any time by applying a torque to shaft 15 opposite to its direction of rotation. The torque can be applied by attempting to reinsert the crank handle into the shaft and also by bringing any other object into frictional contact with shaft 15, like for example the operator's hand Thereby the friction grip created by the O-ring 50 between pinion 20 and shaft 15 is overcome, allowing the pinion 20 to rotate relative to shaft 15 and thereby to activate the friction brake as described above.

Axial pressure generated by the brake disk is born by counter bearing 30, which constitutes a torque transmitting disk 27 and an axial force transmitting disk 29. The axial force transmitting disk 27 has an opening extending from its center to its periphery, enabling it to slide radially into counter bearing groove 33. At about half of the length of the opening, closer to the center of the disk, the width of the opening is about the same as the internal diameter of axial force transmitting disk 29. The torque transmitting disk 27 is bent close to its outer circumference such that its cross-section in an axial plane through its center has an L-shape at one extremity and an inverted L-shape at the other extremity. Thus, the torque transmitting disk 27 forms a receiving cavity which is enclosed in radial direction by the torque transmitting disk's circumferential section and in axial direction by the torque transmitting disk's center section.

The outer diameter of the torque transmitting disk 27 is larger than that of the axial force transmitting disk 29, so the that axial force transmitting disk 29 is received in the receiving cavity of the torque transmitting disk 27. In this arrangement, the torque transmitting disk 27 is immobilized in one axial direction by the axial force transmitting disk 29, and the axial force transmitting disk 29 is immobilized in a radial direction by the circumferential section of torque transmitting disk 27. Since the torque transmitting disk is immobilized in the other axial direction by brake disk 23, both disks are securely mounted on shaft 15 when the hand winch 1 is in the assembled state.

It is understood that the above is only one possible embodiment and should not be used to limit the scope of the invention as set forth by the following claims.

What is claimed is:

1. A hand winch comprising: a winding roll for receiving a flexible elongated member; a manually operated shaft acting on the winding roll; a friction brake including a brake disk slidably mounted on said shaft and a gear member engaging said winding roll and mounted on said shaft such that said gear member can move between a release position and a brake position in which said gear member enters into frictional contact with said brake disk, thus generating a braking torque opposite to a direction of winding off said flexible elongated member for braking said winding roll; and in which said brake disk applies an axial force generated by said gear member onto counter bearing means mounted on said shaft for separately applying both torsional forces and axial forces to said shaft.

2. A hand winch as in claim 1, in which said counter bearing means comprises a torque transmitting disk mounted on said shaft for transmitting torsional forces to said shaft without transmitting any substantial axial forces to said shaft, and an axial force transmitting disk separate from said torque transmitting disk and mounted on said shaft for transmitting axial forces to said shaft without transferring any substantial torsional forces to said shaft, wherein said torque transmitting disk comprises a non-rotational hole for receiving said shaft, and in which said shaft has a respective non-rotational portion engaged with said hole in said torque transmitting disk.

3. A hand winch as in claim 2, in which said axial force transmitting disk comprises a rotational opening cooperating with a another shaft portion having a respective rotational groove allowing rotation of said disk about said shaft.

4. A hand winch as in claim 1 in which said counter bearing means comprises a torque transmitting disk for applying torsional forces to said shaft without applying any substantial axial forces to said shaft, and an axial force transmitting disk for transmitting axial forces to said shaft without applying any substantial torsional forces to said shaft.

5. A hand winch comprising:

a winding roll for receiving a flexible elongated member, a manually operated shaft acting on said winding roll, and a friction brake including, a brake disk and a gear member engaging with said winding roll and mounted on said shaft such that said gear member can move between a release position and a brake position in which said gear member enters into frictional contact with said brake disk, thus generating a braking torque opposite to a direction of winding off said flexible elongated member, for braking said winding roll, wherein said brake disk is slidably mounted on said shaft such that it transmits an axial force generated by said gear member onto a counter bearing arranged on said shaft, said counter bearing comprising a torque transmitting disk mounted on said shaft for transmitting torsional moments to said shaft without transmitting any substantial axial forces to said shaft, and an axial force transmitting disk separate from said torque transmitting disk and mounted on said shaft for transmitting axial forces to said shaft without transferring any substantial torsional moments to said shaft.

6. The hand winch as in claim 5 in which said torque transmitting disk comprises a non-rotational hole for receiving said shaft and in which said shaft has a respective non-rotational portion engaged with said hole in said torque transmitting disk.

7. The hand winch as in claim 5 in which said axial force transmitting disk comprises a rotational opening cooperating with a respective shaft portion having a rotational groove allowing rotation of said axial force transmitting disk about said shaft.

* * * * *